US005643237A

United States Patent [19]

Fechillas et al.

[11] Patent Number: 5,643,237

[45] Date of Patent: Jul. 1, 1997

[54] FACING MATERIAL WITH IMPROVED STAIN RESISTANCE

[75] Inventors: Michael R. Fechillas, East Brunswick, N.J.; Roger Boulanger, Ste-Julie; Erol Tan, Anjou, both of Canada

[73] Assignee: Chicopee, Dayton, N.J.

[21] Appl. No.: 868,614

[22] Filed: Apr. 14, 1992

Related U.S. Application Data

[63] Continuation of Ser. No. 424,001, Oct. 19, 1989, abandoned, which is a continuation of Ser. No. 310,561, Feb. 14, 1989, abandoned, which is a continuation of Ser. No. 869,156, May 30, 1986, abandoned.

[51] Int. Cl.[6] ..... A61F 13/15

[52] U.S. Cl. ..... 604/366; 604/365; 604/367; 604/375; 604/381; 604/382

[58] Field of Search ..... 604/365, 366, 604/367, 381, 382, 372, 375

[56] References Cited

U.S. PATENT DOCUMENTS

| | | | |
|---|---|---|---|
| 2,039,312 | 5/1936 | Goldman | 604/366 |
| 2,705,688 | 4/1955 | Ness et al. | 128/112 |
| 2,862,251 | 12/1958 | Kalwaites | 604/358 |
| 3,056,406 | 10/1962 | Ness | 604/381 |
| 3,068,187 | 12/1962 | Bolstad et al. | 604/381 |
| 4,624,666 | 11/1986 | DeRossett et al. | 604/365 |

*Primary Examiner*—David Isabella
*Assistant Examiner*—K. M. Reichle
*Attorney, Agent, or Firm*—Juettner Pyle Lloyd & Piontek

[57] ABSTRACT

A nonwoven, stain resistant facing for absorbent articles is disclosed. The facing material is in the form of a nonwoven fabric including hydrophobic staple fibers bonded with an absorbent adhesive. The fabric is formed in such a manner as to have a plurality of apertures. The fibers of the fabric and the cured adhesive are coated with a fluorochemical repellant.

4 Claims, 7 Drawing Sheets

FACING MATERIAL WITH IMPROVED STAIN RESISTANCE

This is a continuation of application Ser. No. 424,001, filed Oct. 19, 1989, which in turn is a continuation of application Ser. No. 310,561, filed Feb. 14, 1989, which in turn is a continuation of application Ser. No. 869,156, filed May 30, 1986, all now abandoned, which are hereby incorporated by reference.

The present invention relates to facing materials for absorbent products, and specifically to clean, dry facings for sanitary napkins.

BACKGROUND OF THE INVENTION

Facing layers have long been used in absorbent products to contain the absorbent core media and provide a surface for contacting the skin. Initially facings were developed for their softness, absorbency, and bulk or cushioning effect. Facings have also been developed which have improved fluid transfer properties. These facings have been characterized by a reduced rate of absorbency and reduced strike back of fluid from the absorbent core. One such facing is disclosed in U.S. Pat. No. 4,391,869 which describes a low density fabric of resin bonded synthetic polyester fibers. The fabric is saturation bonded and may be subject to conventional after treatments, including a repellent coating. Due to the overall binder coating, this fabric if repellent coated would not exhibit the enhanced repellency or stain resistance of the facing of the present invention.

Apertured plastic films have also been used in facings to reduce strike back, however, they have typically been used in conjunction with fabric layers to give the facing a cloth-like surface feel. Though a "plastic feel" is not desired in a facing, when apertured plastic films have been used as the top surface of a facing, the facings exhibit a clean dry surface, due to the repellent or hydrophobic properties of the plastic. One such facing is described in U.S. Pat. No. 4,324,246.

The facing of the present invention is a repellent fibrous facing, which exhibits a clean, dry surface, without the "plastic feel" of an apertured plastic film facing. The enhanced repellency of the facing is achieved by a repellent top coat on a fibrous layer with only an intermittent binder coating.

SUMMARY OF INVENTION

The present invention comprises a nonwoven facing material with improved stain resistance, and a method for making the same. The facing material is useful as a facing for absorbent products, and particularly for sanitary products. The facing material of the present invention comprises a web of hydrophobic staple fibers, intermittently bonded with an absorbent binder material, and top coated with a repellent material, preferably a fluorochemical repellent material.

In one preferred embodiment of the invention, the web of hydrophobic fibers is apertured prior to the application of binder and repellent. The apertured web may be produced by the fluid rearranging process described in U.S. Pat. No. 2.862.251, wherein the fibers are rearranged into a pattern of yarn-like bundles defining a pattern of apertures therebetween. When the web is apertured in this manner, it is preferred that the web contain approximately 5% to 20%, and most preferably 12% by weight of rayon staple fibers. The facings of the present invention exhibit improved repellency and stain resistance in terms of both stain area and stain intensity.

DETAILED DESCRIPTION OF THE INVENTION

Figure 1:
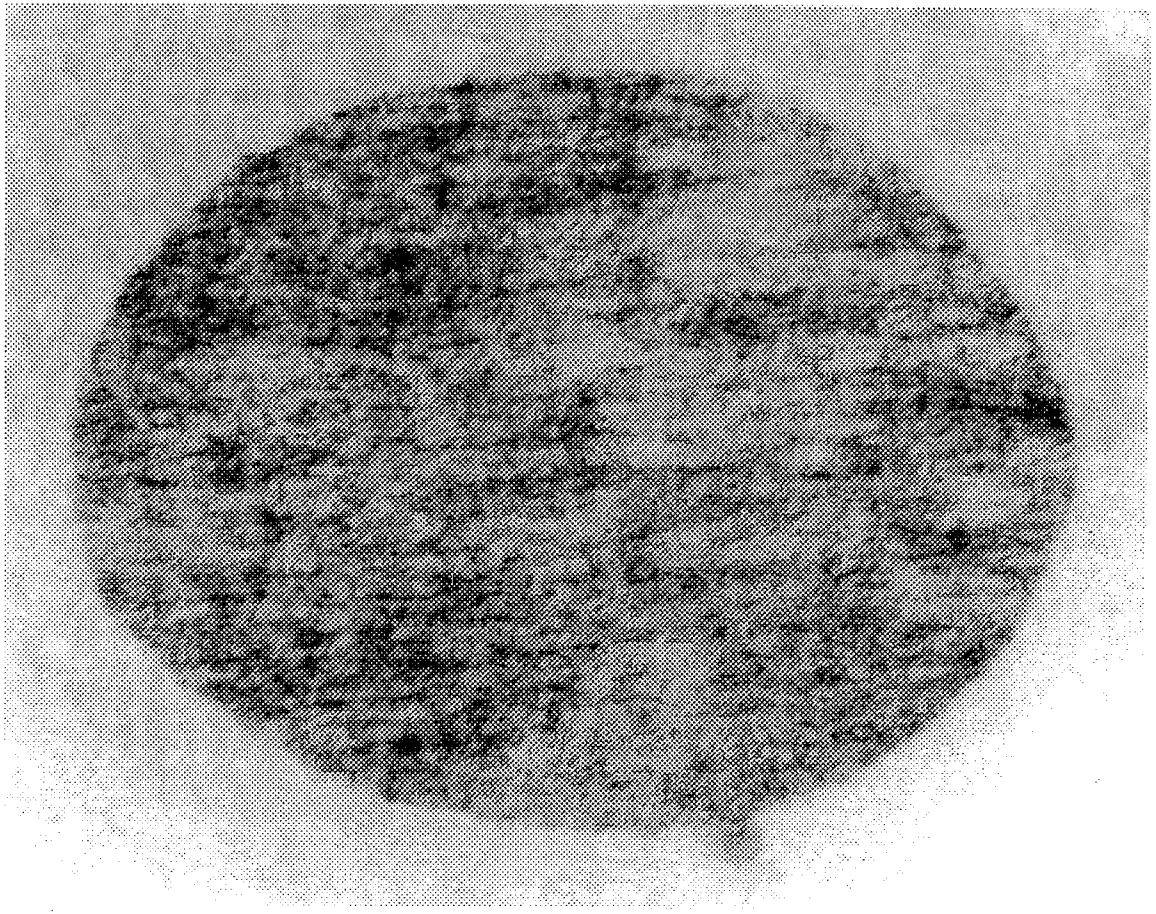
FIGS. 1–7 are 5× photomacrographs of various fibrous facing materials.

The facing material of the present invention is made from a starting web comprising hydrophobic fibers, such as polyester, acrylic, orlon, or nylon staple fibers. The web may comprise carded fibers, randomly arranged fibers as in an air-laid web, or a combination thereof. The web of fibers is intermittently bonded with an absorbent binder material, and top coated with a repellent material. As used in this application intermittent bonding refers to a binder pattern on the final fabric in which, after curing, the binder areas are well spaced from each other. Such a pattern may be achieved with a rotogravure roll with a diamond or diagonal pattern of print lanes with 6 lines per inch. As is well known the pattern of cured binder areas in the fabric way depend on many factors, including the pattern of application of the binder, the amount of binder added and the degree of migration of the binder, however, one skilled in the art is readily able to design and achieve an intermittent pattern of cured binder in a fabric. Generally, the binder areas in the facing fabric of the present invention should comprise approximately 20% to 50% of surface area of the fabric. The absorbent binder used may be any one of the commercially available absorbent binders such as National Starch 4260 acrylic binder. B. F. Goodrich 2671 acrylic binder, or National Starch 125-2873 vinyl acetate/acrylic copolymer absorbent binder. The repellent may be any of the commercially available repellent materials such as the wax based solutions or emulsions, but is preferably a fluorochemical repellent material.

In a preferred embodiment of the invention the web is apertured for improved fluid strike through. According to a preferred embodiment of the process of the present invention, the starting web may be apertured by the fluid rearranging method described in U.S. Pat. No. 2,862,251 which produces a web comprising yarn-like bundles of fibers with a pattern of apertures therebetween. When the apertures are produced in this manner it is preferred that the web comprise approximately 5% to 20%, and most preferably 12% by weight of rayon staple fibers for enhanced aperture clarity. A loss in aperture clarity, with the fibers extending into and across the apertures, reduces fluid strike through and can result in increased staining of the facing. Though rayon/polyester fabrics of 25, 75 and 100 percent polyester fibers show gradually increasing stain resistance, a fabric of 88% polyester and 12% rayon exhibits a further increase in aperture clarity and stain resistance.

The facings of the present invention are repellent and show improved stain resistance in terms of reduced stain area and stain intensity. Surprisingly, this improved stain resistance is achieved with the use of an absorbent binder. As set forth in the following Table, the facing of the present invention exhibits greatly improved stain resistance over fabrics made with repellent binders, and those made with an overall application of absorbent binder.

In the following Table, the fabric of sample 1, shown at 5× in FIG. 1, has a stain area of 4.4 sq. in. and a stain intensity of 23.4 as measured on a Hunter Color-imeter, as described below. Sample 1 is a 260 grains/yd$^2$ card and bind fabric, consisting of 220 grains/yd$^2$ of a fiber blend of 50% Avtex SN 1913 rayon staple fibers and 50% Celanese 417 polyester staple fiber, with an overall coating of 40 grains/yd$^2$ of B. F. Goodrich 2671 acrylic absorbent binder. As may be seen in FIG. 1, this fabric exhibits a large, intensely colored stain and hence is not stain resistant.

Figure 2:
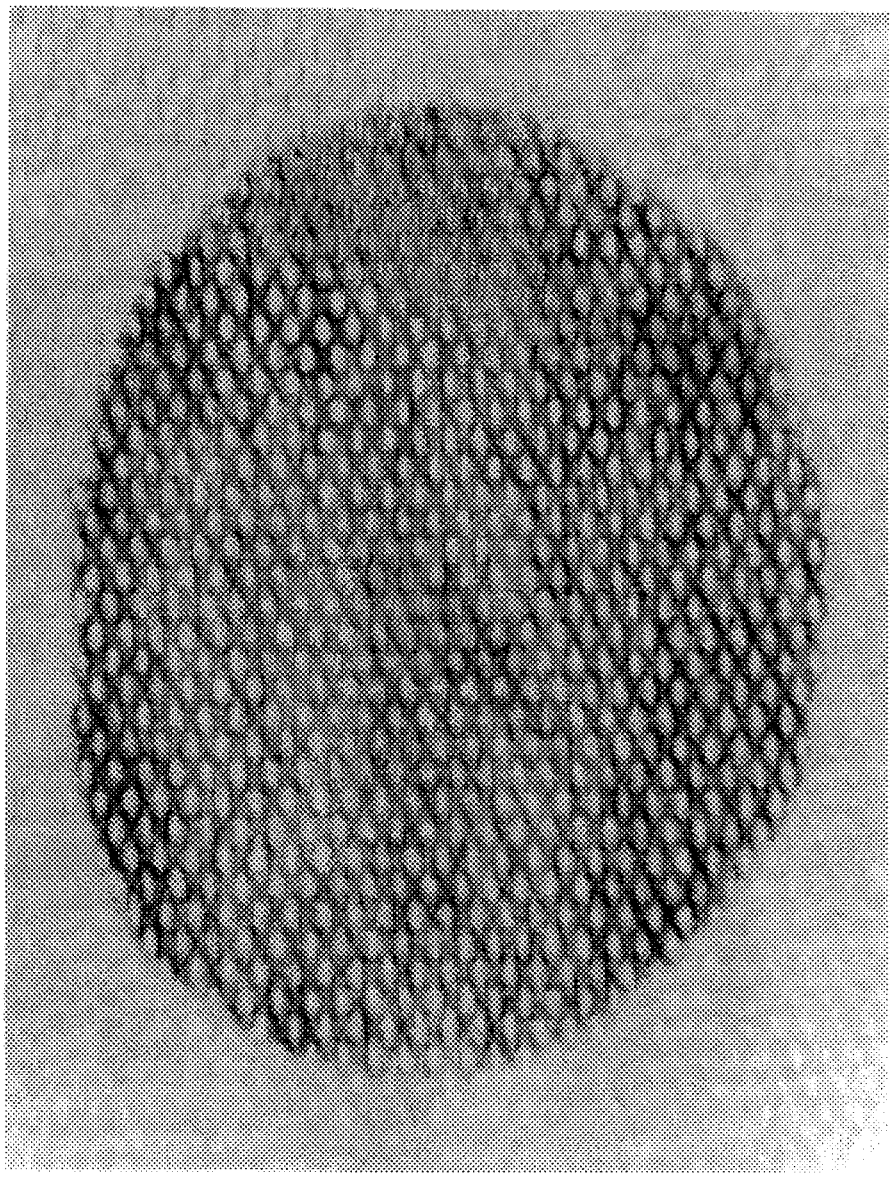

Sample 2, shown at 5× in FIG. 2, is a 325 grains/yd fabric consisting of 212 grains/yd$^2$ of a carded web of a blend of 50% 1.7 denier 1.5 inch Lenzing Lenzesa rayon and 50% 1.7 denier 1.5 inch DuPont 372 polyester fiber rearranged according to the method of U.S. Pat. No. 2.862.251, at 120–130 psi water pressure on a drum with 165 holes/in$^2$. Thereafter. 113 grains/yd$^2$ of binder solution is foamed into the web to provide an overall coating of binder. The binder used is National Starch 125-2873 vinyl acetate/acrylic self cross linking copolymer absorbent binder with 11 grains of repellent micro-crystalline wax emulsion with Zirconium salts, which renders the binder solution repellent. Sample 2 shows only slight improvement in stain area and intensity over sample 1.

Figure 3:
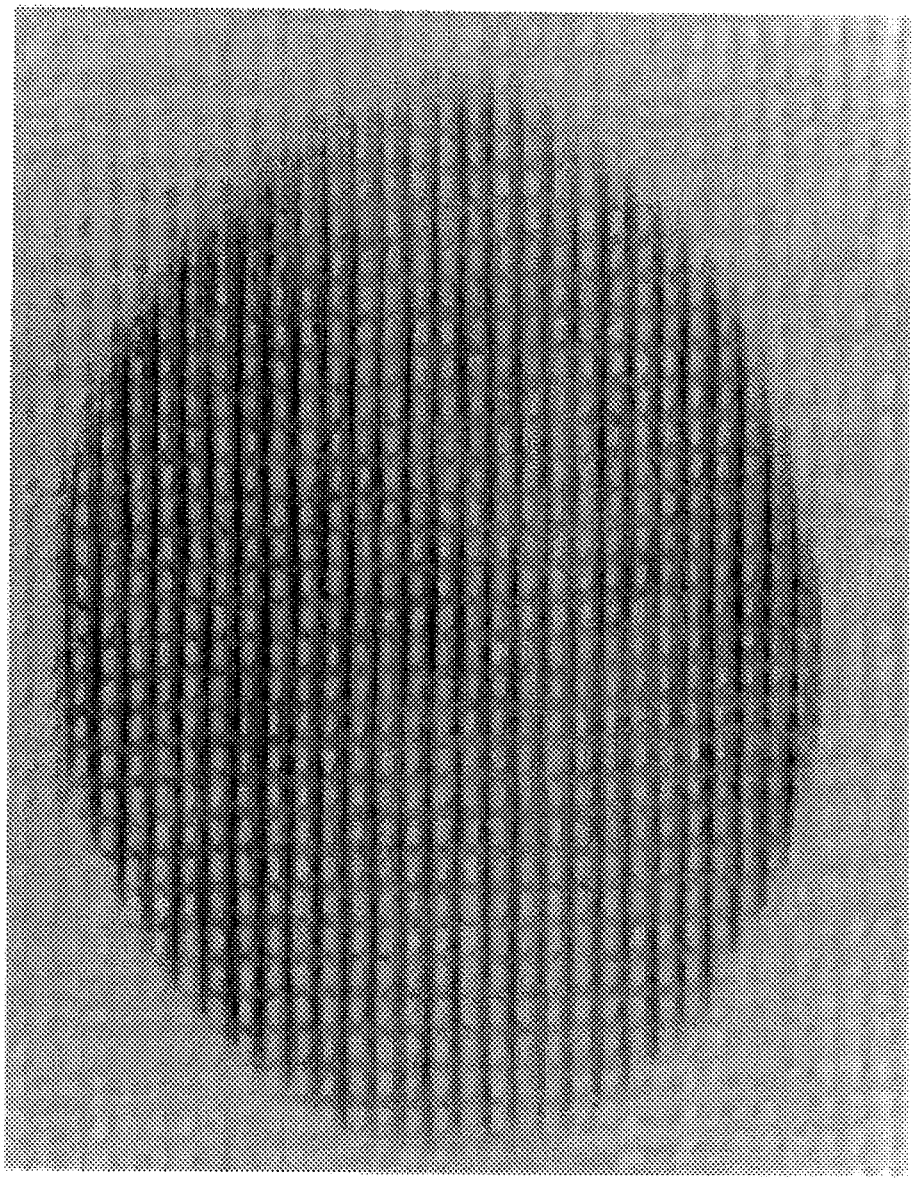

Sample 3, shown at 5× in FIG. 3, is a 285 grains/yd$^2$ fabric consisting of 228 grains/yd$^2$ of a carded web of a blend of 88% by weight Celanese D-244 1.2 denier 1.5 inch polyester staple fiber and 12% by weight Avtex SN 1913 1.5 denier 1⅛ inch Rayon staple fiber, with 56 grains/yd$^2$ of binder solution of National Starch 4260 acrylic absorbent binder, rendered repellent with I.C.I. F-31X fluorochemical repellent. The fibers were rearranged with 120–130 psi of water, at 120°–130° F. using a 73.4×73.4 belt and a drum with 144 holes/in$^2$, prior to the addition of the binder solution, applied with a rotogravure roll at 23 lines per inch to achieve overall saturation bonding. After the binder was cured, the fabric was top coated with ICI F-31X repellent in a padder operation resulting in 1 grain/yd$^2$ repellent coating. The sample has a stain area and intensity similar to sample 2.

Figure 4:
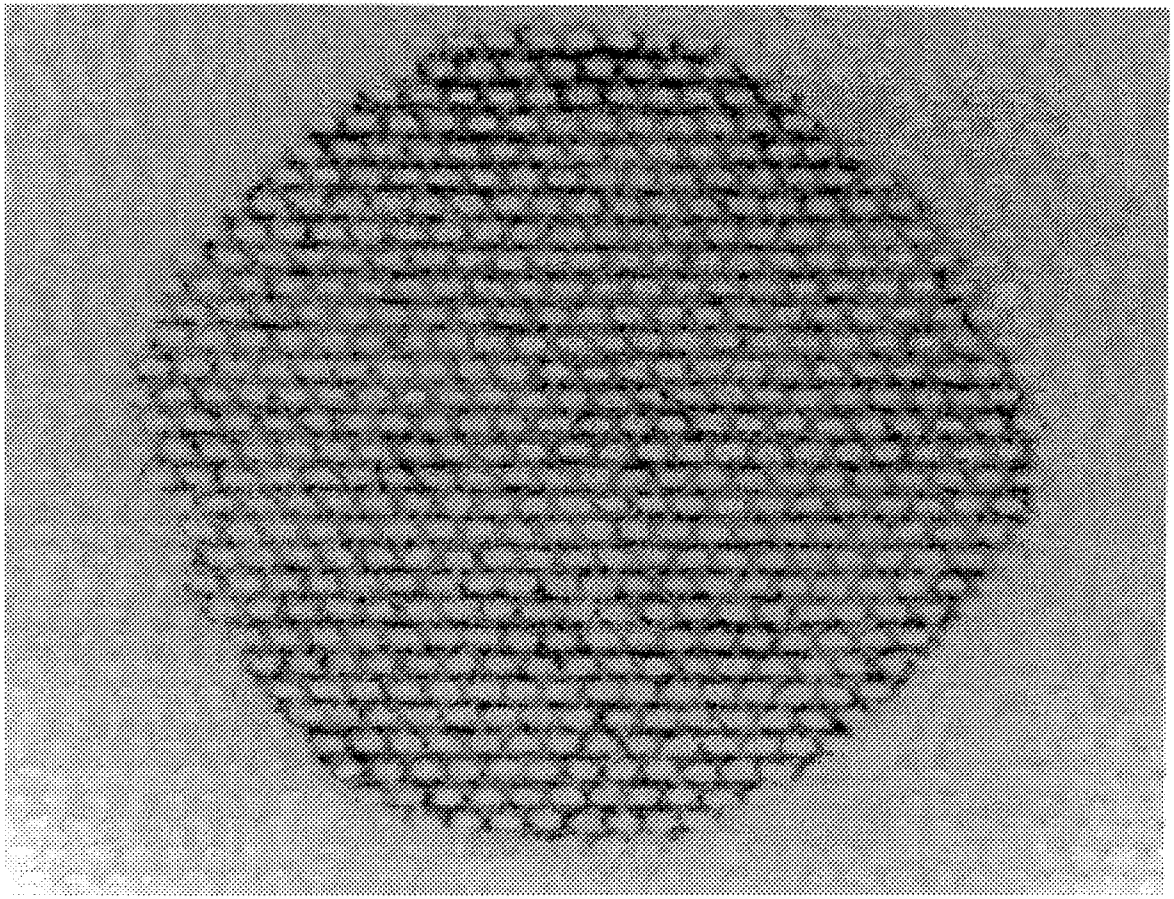

Sample 4, shown at 5× in FIG. 4, is a 350 grains/yd$^2$ fabric consisting of 242 grains/yd$^2$ of a carded web of Hoechst T-221 1.25 denier 1½ inch, polyester fiber rearranged as sample 3, with 97 grains/yd$^2$ of a binder solution of Rohm & Haas NW-1284 repellent acrylic binder to which $TiO_2$ has been added for fabric opacity. The binder solution is applied with a 23 line per inch roto-gravure roll to achieve overall binder saturation. After curing, the fabric is top coated with a 3M FC-824 fluorochemical repellent in a padder operation resulting in a 1 grain/yd$^2$ repellent coating. The sample shows some improvement in stain area and intensity, but is difficult to produce as the $TiO_2$ is difficult to maintain in solution and dries quickly, fouling the lanes of the rotogravure roll.

Figure 5:
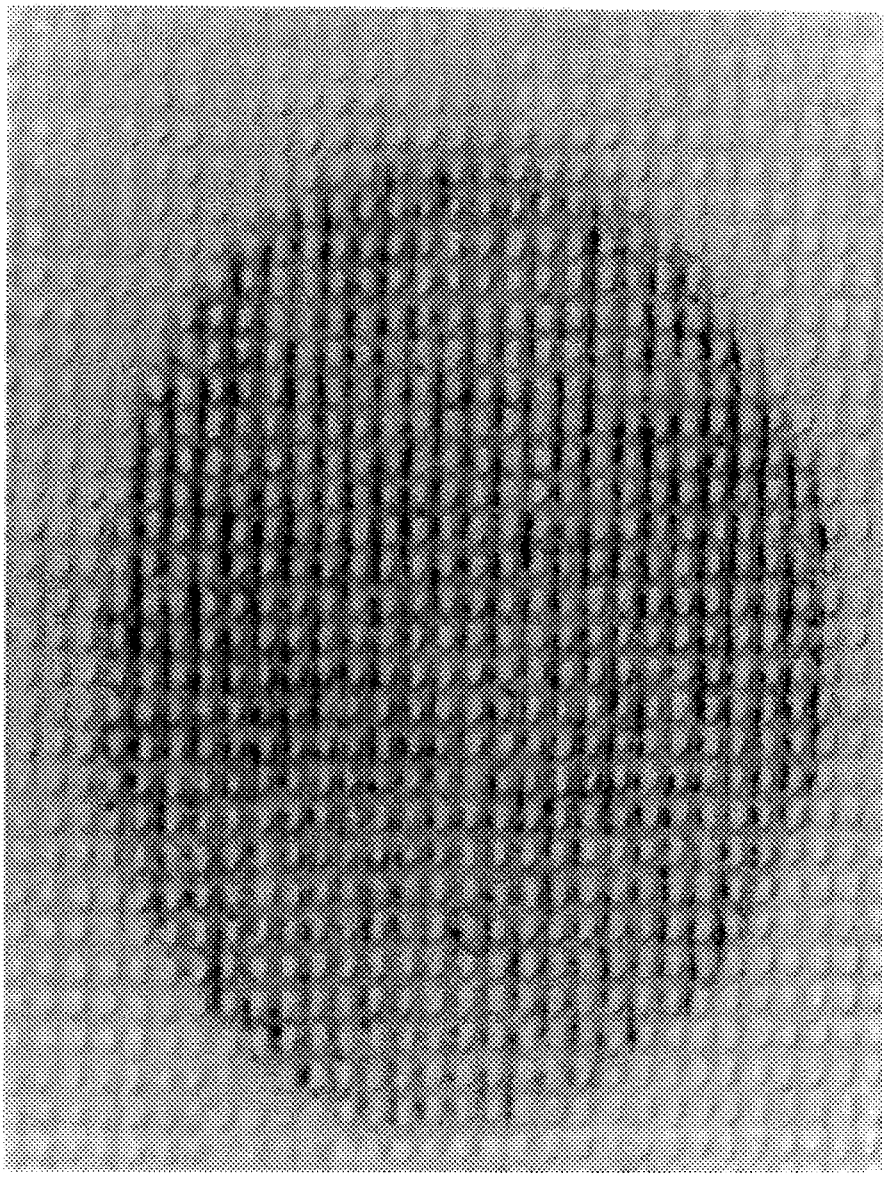
Figure 6:
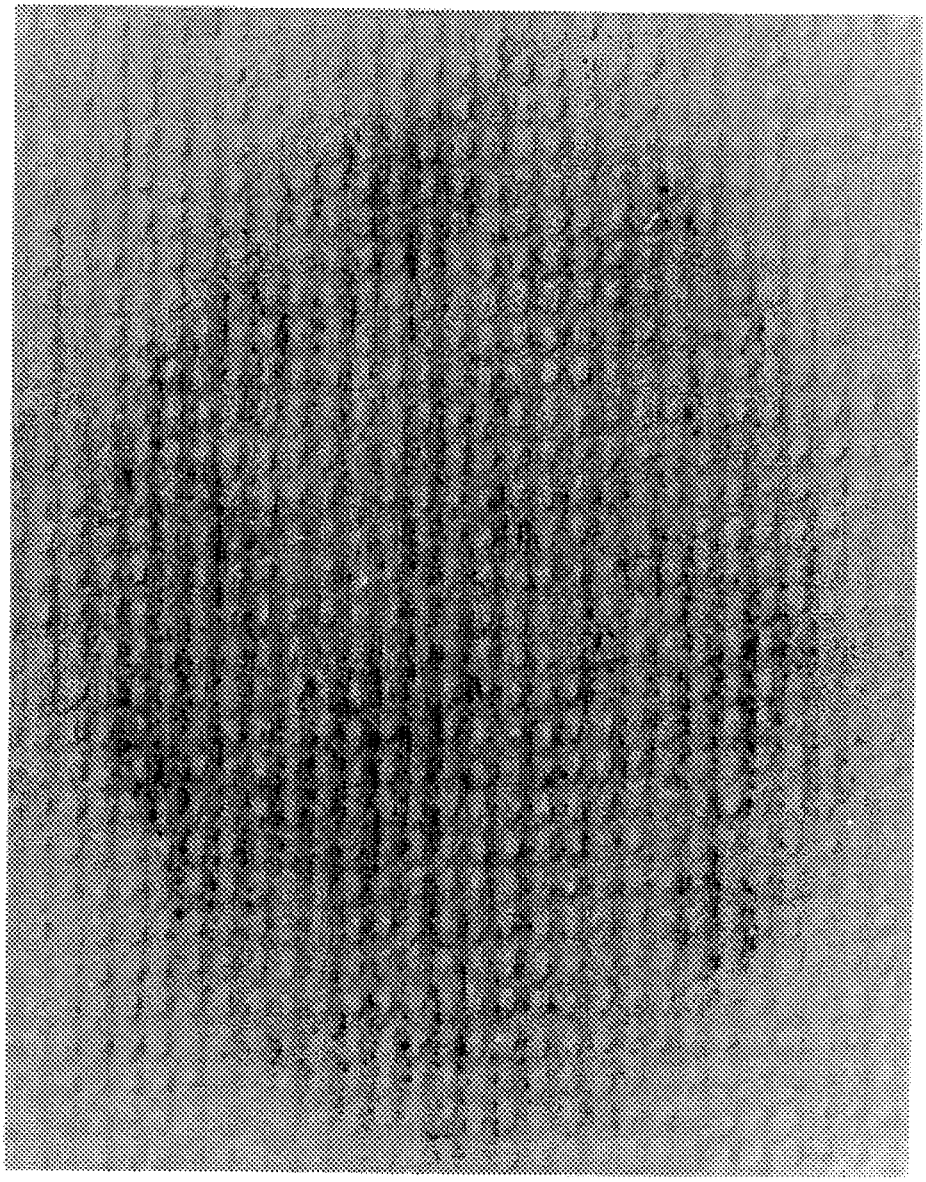
Figure 7:
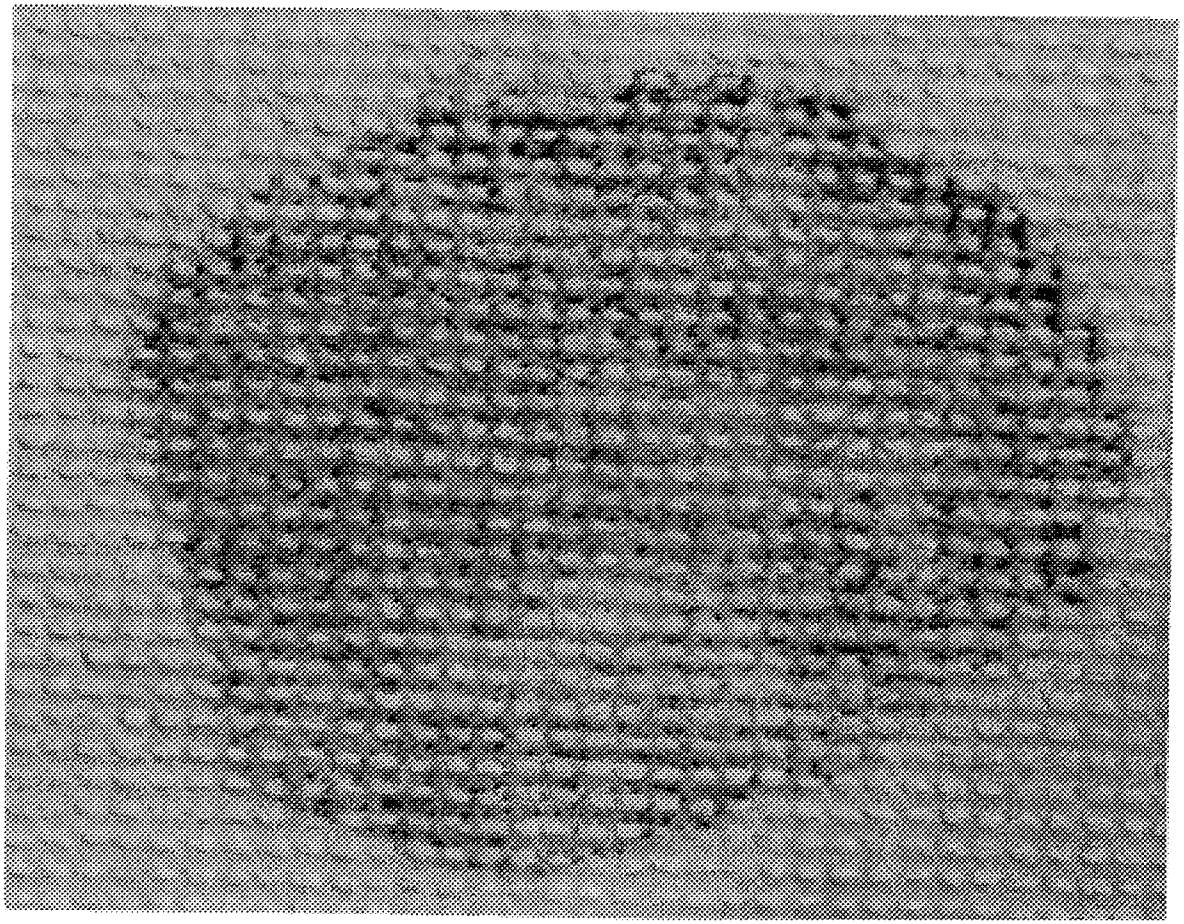

Sample 5, shown at 5X in FIG. 5, is a 280 grain/yd$^2$ fabric consisting of 229 grains/yd$^2$ of a carded web of a blend of 88% by weight Celanese D-244 1.2 denier, 1.5 inch polyester staple fiber containing 1.5% $TiO_2$, and 12% by weight of Avtex SN-1913 1.5 denier 1⅛ inch rayon staple fiber rearranged as sample 3, with 50 grains/yd$^2$ of National Starch 4260 acrylic absorbent binder applied with a rotogravure roll at 23 lines/in to achieve overall saturation bonding. After curing the binder, the fabric is top coated with I.C.I. F-31X repellent in a padder operation resulting in a 1 grain/yd$^2$ repellent coating. This sample shows similar stain area and intensity to sample 4.

Sample 6 is a 280 grains/yd$^2$ fabric consisting of 229 grains/yd of a carded web of the fiber blend of sample 5 and 50 grains/yd$^2$ of National Starch 4260 acrylic absorbent binder, rearranged as sample 3. The binder is applied with a rotogravure roll in a diamond pattern of 6 lines/in at a 30° angle, the lanes of the print roll being 0.014" wide and 0.004" deep. After curing the binder, the fabric is top coated with I.C.I. F-31X repellent in a padder operation resulting in a 1 grain/yd$^2$ repellent coating. The sample exhibits an unexpected stain resistance, with a stain area of only 3.5 sq. in. and a stain intensity of only 4.8

Sample 7 is a 280 grains/yd$^2$ fabric of a 229 grain/yd$^2$ carded web of the fiber blend of samples 5 and 6, rearranged as sample 3, with 50 grains/yd$^2$ of Rohm and Haas 1715 repellent binder applied with the same rotogravure roll as used in making sample 6. After curing the binder, the fabric is top coated with I.C.I. F-31X repellent in a padder operation resulting in a I grain/yd$^2$ repellent coating. The sample exhibits a stain area and intensity similar to sample 5.

TABLE

| Sample | Fiber | Binder | Binder Application | Repellant Top Coat | Stain Area[1] | Stain Intensity[2] |
|---|---|---|---|---|---|---|
| 1 | 50% Rayon 50% PET carded | absorbent | overall | no | 4.4 | 23.4 |
| 2 | 50% Rayon 50% PET rearranged | absorbent rendered repellent | overall | no | 4.14 | 16.9 |
| 3 | 12% Rayon 88% PET with $T_iO_2$ rearranged | absorbent rendered repellent | overall | yes | 4.15 | 17.3 |
| 4 | 100% PET rearranged | repellent with $T_iO_2$ | overall | yes | 3.68 | 12.6 |
| 5 | 12% Rayon 88% PET with $T_iO_2$ rearranged | absorbent | overall | yes | 3.8 | 11.6 |
| 6 | 12% Rayon 88% PET with $T_iO_2$ rearranged | absorbent | intermittent | yes | 3.5 | 4.8 |
| 7 | 12% Rayon 88% PET with $T_iO_2$ rearranged | repellent | intermittent | yes | 3.79 | 10.0 |

TABLE-continued

| Sample | Fiber | Binder | Binder Application | Repellant Top Coat | Stain Area[1] | Stain Intensity[2] |
|---|---|---|---|---|---|---|

[1]Stain Area measured by the following test: The facing material was adhesively bonded to an absorbent core of wood pulp fibers by spraying the undersurface of the facing with H.B. Fuller hot melt adhesive prior to assembling the facing on the absorbent core. The napkin was secured to a smooth surface, with the facing layer comprising the facing material exposed. A 10" × 3" plexiglass template with a central oval opening 1½" long and ¾" wide as placed over the napkin and 15 c.c. of synthetic menstrual fluid was poured into the oval opening. The template was removed, a 2.2 kg roller was placed atop the stain, rolled to one longitudinal end of the napkin and back across the stain to the other end, and back again, to traverse the length of the napkin 10 times. The roller then was removed and the facing allowed to dry. The stain area was measured using a Nikon Micro-plan II image analysis system manufactured by Laboratories Computer Systems Inc., 139 Main Street, Cambridge, Massachusetts. The average of ten measurements of the area is reported. The synthetic menstrual fluid used was an electrolytically active solution with a surface tension approximating that of menstrual fluid, and containing a red dye.

[2]Stain Intensity measured on a Hunter Color-Difference Meter Model D-25-2 optical sensor from Hunter Associates Laboratory Inc., Fairfax, Virginia.

The above Table demonstrates the unexpected stain resistance of the facing of the present invention, comprising hydrophobic fibers intermittently bonded with an absorbent binder, and top coated with a repellent finish. The facing material of the present invention may be used as the facing layer of absorbent products such as sanitary napkins. When used as a facing layer, the facing material may be Juxtaposed to the top surface of the absorbent core Of the napkin, with or without an intervening fibrous layer, such as tissue, and may be glued in place or merely positioned on the napkin. The facing material may be wrapped around the absorbent core, and a fluid impervious layer may be positioned in the napkin beneath the absorbent core.

We claim:

1. A nonwoven facing material with improved stain resistance, said facing material comprising a web of hydrophobic staple fibers intermittently bonded with an absorbent binder, said fibers and said binder being coated, after curing of said binder, with a repellant material, said web having a plurality of apertures therethrough, said repellant material is a fluorochemical repellant material and said web comprises from about 80% to about 95% by weight of the fibers of hydrophobic fibers and, correspondingly, from about 20% to about 5% by weight of the fibers of rayon staple fibers.

2. The nonwoven facing material of claim 1 wherein said web comprises about 88% by weight of the fibers of polyester fibers and about 12% by weight of the fibers of rayon staple fibers.

3. A nonwoven facing material with improved stain resistance, said facing material comprising a web of hydrophobic staple fibers intermittently bonded with an absorbent binder, said fibers and said binder being coated, after curing of said binder, with a repellant material, said web having a plurality of apertures therethrough, said fibers of said web being rearranged into yarn-like bundles defining said apertures, said web comprising from about 80% to about 95% by weight of the fibers of hydrophobic fibers and, correspondingly, from about 20% to about 5% by weight of the fibers of rayon staple fibers.

4. A method of making a nonwoven facing material with improved stain resistance, comprising the steps of a. forming a web of hydrophobic staple fibers, b. rearranging the fibers of said web to form yarn-like bundles with a pattern of apertures therein, c. applying an absorbent binder material to said rearranged web of fibers, in an intermittent pattern, d. curing said absorbent binder material, e. applying a fluorochemical repellent material to said web, and f. curing said repellent material to form a repellent treated fabric, wherein said web comprises 88% by weight of fibers of polyester and 12% by weight of rayon staple fibers.

* * * * *